United States Patent [19]

Reponty

[11] Patent Number: 4,970,953

[45] Date of Patent: Nov. 20, 1990

[54] DAMPENER ROLL HAVING BRISTLES OF LONGER LENGTH AT OPPOSITE END PORTIONS

[75] Inventor: Andre Reponty, Gouvieux, France

[73] Assignee: Harris Graphics Corporation, Dover, N.H.

[21] Appl. No.: 406,794

[22] Filed: Sep. 13, 1989

[51] Int. Cl.[5] ..... B41F 7/28; B41L 23/06; B41L 25/04

[52] U.S. Cl. ..... 101/148

[58] Field of Search ..... 101/147, 148, 350, 363, 101/207-210, 132.5; 239/220, 214; 29/120, 121.1, 132; 118/258, 262, DIG. 15, DIG. 16

[56] References Cited

U.S. PATENT DOCUMENTS 2,868,118 1/1959 Dahlgren .

3,257,940 6/1966 Strudwick ..... 118/DIG. 16

3,411,441 11/1968 Hermach et al. .

3,545,379 12/1970 Norton .

4,143,596 3/1979 Ivett .

*Primary Examiner*—J. Reed Fisher

*Attorney, Agent, or Firm*—Tarolli, Sundheim & Covell

[57] ABSTRACT

An improved dampener roll is used to transfer dampening fluid from a reservoir to a printing plate in a lithographic printing press. The dampener roll includes an array of bristles which extends between opposite ends of the dampener fountain roll. The array of bristles includes a central portion and first and second end portions which are disposed at opposite ends of the roll. The bristles at the first and second end portions of the array of bristles are longer than the bristles at the central portion of the array of bristles.

4 Claims, 3 Drawing Sheets

DAMPENER ROLL HAVING BRISTLES OF LONGER LENGTH AT OPPOSITE END PORTIONS

BACKGROUND OF THE INVENTION

The present invention relates to a dampener roll and more specifically to a dampener roll of the brush type, which is used to transfer dampening fluid from a reservoir to a printing plate in a lithographic printing press.

During operation of a lithographic printing press, dampening fluid is transferred from a reservoir to a printing plate. Brush type dampener rolls have been used to control the amount of dampening fluid transmitted from the reservoir to the printing plate. Examples of known dampeners having brush type rolls are disclosed in U.S. Pat. Nos. 2,868,118; 3,411,441; 3,545,379 and 4,143,596.

During use of these known brush type dampener rolls, the amount of dampening fluid transferred from opposite end portions of the brush roll is less, per unit of length, than the amount of dampening fluid transferred from corresponding units of length of the central portion of the brush roll. It is believed that this is because the bristles at the end portions of the brush roll tend to dry out more than the bristles in the central portion of the roll.

Although it is difficult to be certain exactly why the bristles at the opposite end portions of the brush roll dry out to a greater extent than the bristles in the central portion of the brush roll, it is theorized that this may be due to several different reasons including a transfer of heat to the bristles at the opposite end portions of the brush roll from bearings adjacent to opposite end portions of the brush roll. Also, the bristles at the end portions of the dampener fountain roll may not be wetted to the same extent by adjacent bristles as are bristles at the central portion of the dampener roll. This may be due to the bristles at the end of the roll being more exposed than bristles at the central portion of the roll.

It has previously been suggested that an even transfer of dampening fluid from the brush roll could be obtained by having a greater number of bristles per unit of length of the brush roll at opposite ends of the roll than at the central portion of the roll. When a brush roll having such a construction was tried, it was found that the increased density of the bristles at opposite ends portions of the roll was not satisfactory. Thus, even through the number of bristles per unit of length at the end portions of the brush roll was greater than the number of bristles per unit of length at the central portion of the roll, a satisfactory rate of transfer of dampening fluid along the length of the brush roll was not obtained.

SUMMARY OF THE INVENTION

The present invention provides an improved brush dampener roll for use in transferring dampening fluid from a reservoir to a printing plate in a lithographic printing press. The brush dampener roll includes an array of bristles extending between opposite end portions of the brush dampener roll. The bristles at opposite end portions of the brush dampener roll are longer than bristles at the central portion of the brush dampener roll. It is believed that this results in a greater length of the bristles at the opposite end portions of the brush dampener roll being wetted with dampening fluid than at the central portion of the roll. It is believed that the wetting of a greater length of the bristles at the opposite ends of the brush dampener roll compensates for the tendency of the bristles at the opposite end portions of the brush dampener roll to dry out and thereby results in a more uniform rate of transfer of dampening fluid along the length of the brush dampener roll.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF ONE SPECIFIC PREFERRED EMBODIMENT OF THE INVENTION

Figure 1:
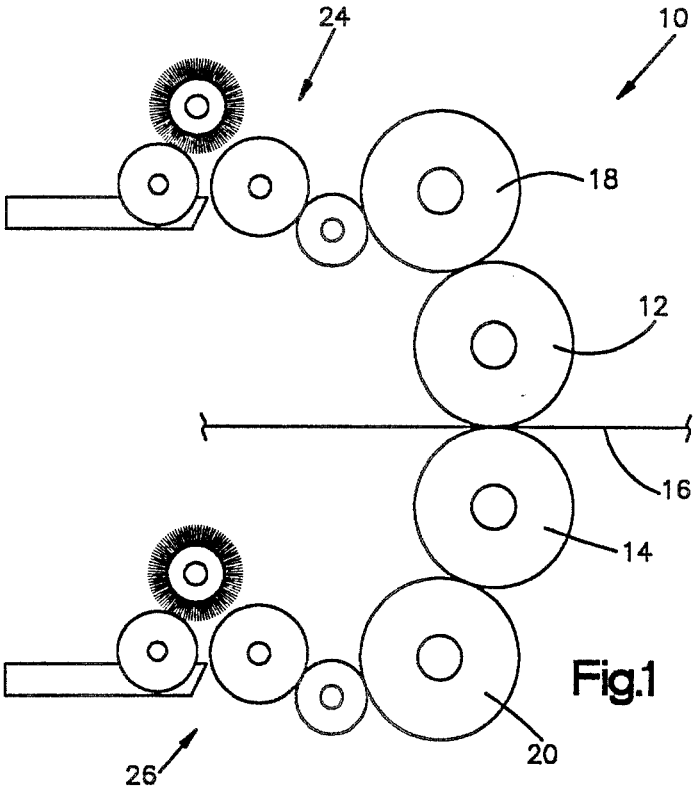
FIG. 1 is a schematic illustration of the relationship between dampeners and plate cylinders in a lithographic printing press.

A lithographic printing press 10 is illustrated schematically in FIG. 1. The lithographic printing press 10 includes upper and lower blanket cylinders 12 and 14 which print on opposite sides of a web 16 in a known manner. Ink images are transmitted from upper and lower plate cylinders 18 and 20 to the blanket cylinders 12 and 14. Ink is applied to printing plates on the plate cylinders 18 and 20 by suitable inkers (not shown). Ink repellent dampening fluid is applied to the printing plates on the plate cylinders 18 and 20 by dampeners 24 and 26, respectively.

The dampener 24 includes a reservoir or pan 32 (FIG. 2) containing a body 34 of ink repellant liquid. A pan roll 36 extends into the body 34 of dampening fluid. The pan roll 36 rotates during operation of the lithographic printing press 10 to conduct a film of dampening fluid upwardly from the liquid 34 in the reservoir 32.

The film of dampening fluid 34 on the pan roll 36 is engaged by an improved brush dampener roll 38. The brush dampener roll 38 flicks ink repellant liquid 34 from the outer periphery of the pan roll 36 to the outer periphery of a vibrator roll 40. The vibrator roll 40 is in fluid transmitting relationship with a form roll 42 which transmits the dampening fluid from the vibrator roll to a printing plate on the plate cylinder 18.

Figure 3:
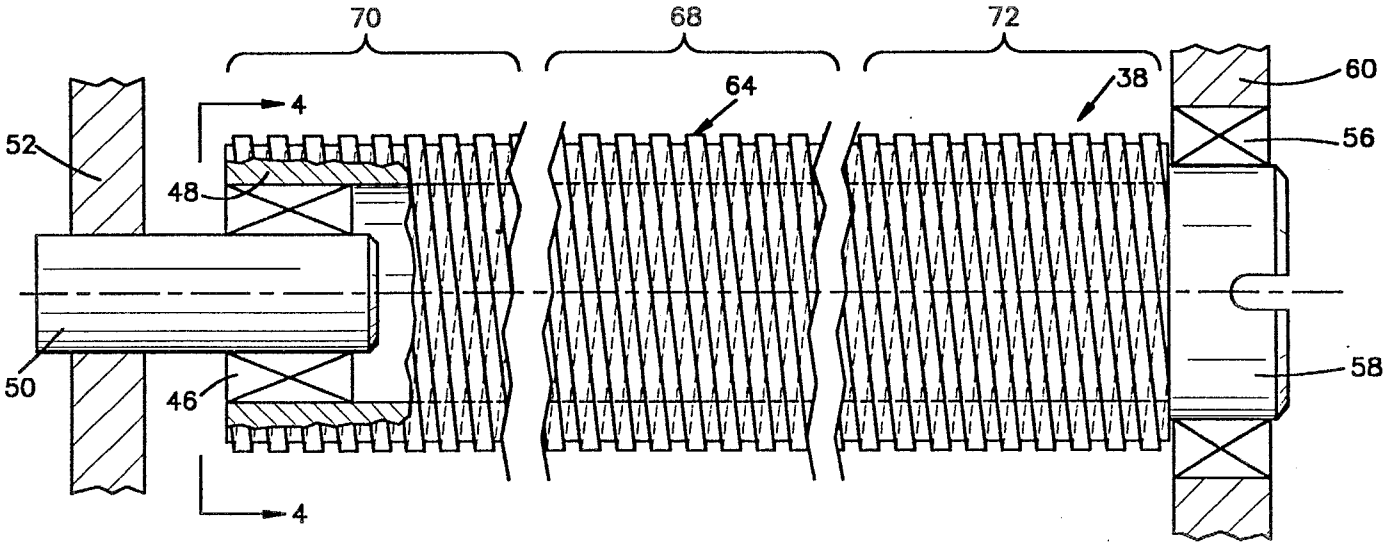
FIG. 3 is an enlarged schematic illustration of a brush dampener roll used in the dampener of FIG. 2.
Figure 4:
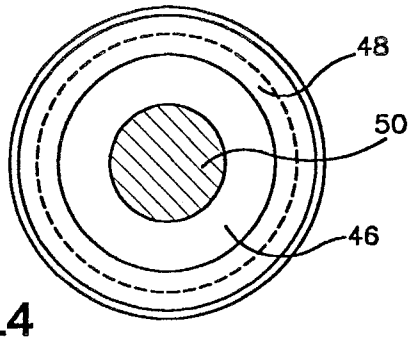
FIG. 4 is an end view, taken generally along the line 4—4 of FIG. 3.

The brush roll 38 is rotatably supported at one end, the left end as viewed in FIG. 3, by an internal bearing assembly 46 which engages the inside of a hollow cylindrical metal base 48 of the roll 38 (FIG. 4). The bearing assembly 46 is supported on a stub shaft 50 (FIG. 3) connected with a frame member 52. The opposite end of the roll 38 is supported by an external bearing assembly 56 which engages a cylindrical end portion 58 on the base 48 and a frame member 60. It should be understood that either internal or external bearing assemblies could be used at either or both ends of the dampener roll 38 to rotatably support the roll in the lithographic printing press 10. It is also contemplated that any other suitable arrangement for mounting the roll 38 could be utilized.

Figure 2:
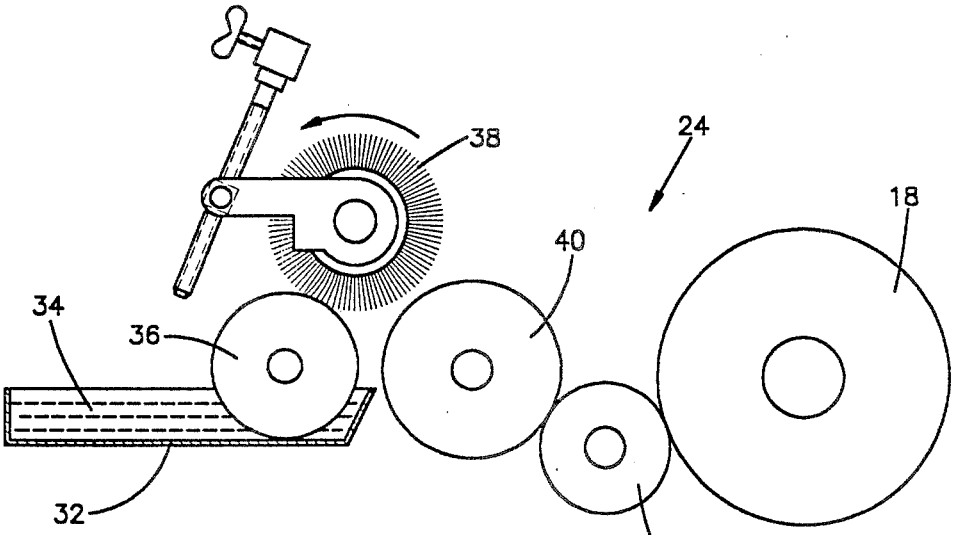
FIG. 2 is an enlarged schematic illustration depicting the construction of one of the dampeners of FIG. 1.

An array 64 of bristles extends between opposite end portions of the cylindrical metal base cylinder 48. During rotation of the roll 38, the array 64 of bristles engages the outer side surface of the pan roll 36. As the bristles in the array 64 of bristles engage the outer side surface of the pan roll 36, each of the bristles is resiliently deflected rearwardly, that is in a direction opposite to the direction of rotation of the roll 38 (FIG. 2) and away from the vibrator roll 40. Each of the bristles of the array 64 (FIG. 5) of bristles has sufficient stiffness and natural resilience so that each bristle snaps back to its original position relative to the base cylinder 48 of the dampener roll 38 as the bristle moves out of engagement with the pan roll 36 (FIG. 2). This results in the dampening fluid on the bristle being flicked forwardly onto the rotating vibrator roll 40 in a known manner.

Each of the bristles of the array 64 of bristles is made of a material having sufficient resilience to enable the bristle to be repeatedly flexed and released with a flicking action. The bristles are formed of a suitable polymeric material. However, other known synthetic or natural materials could be used if desired.

Figure 5:
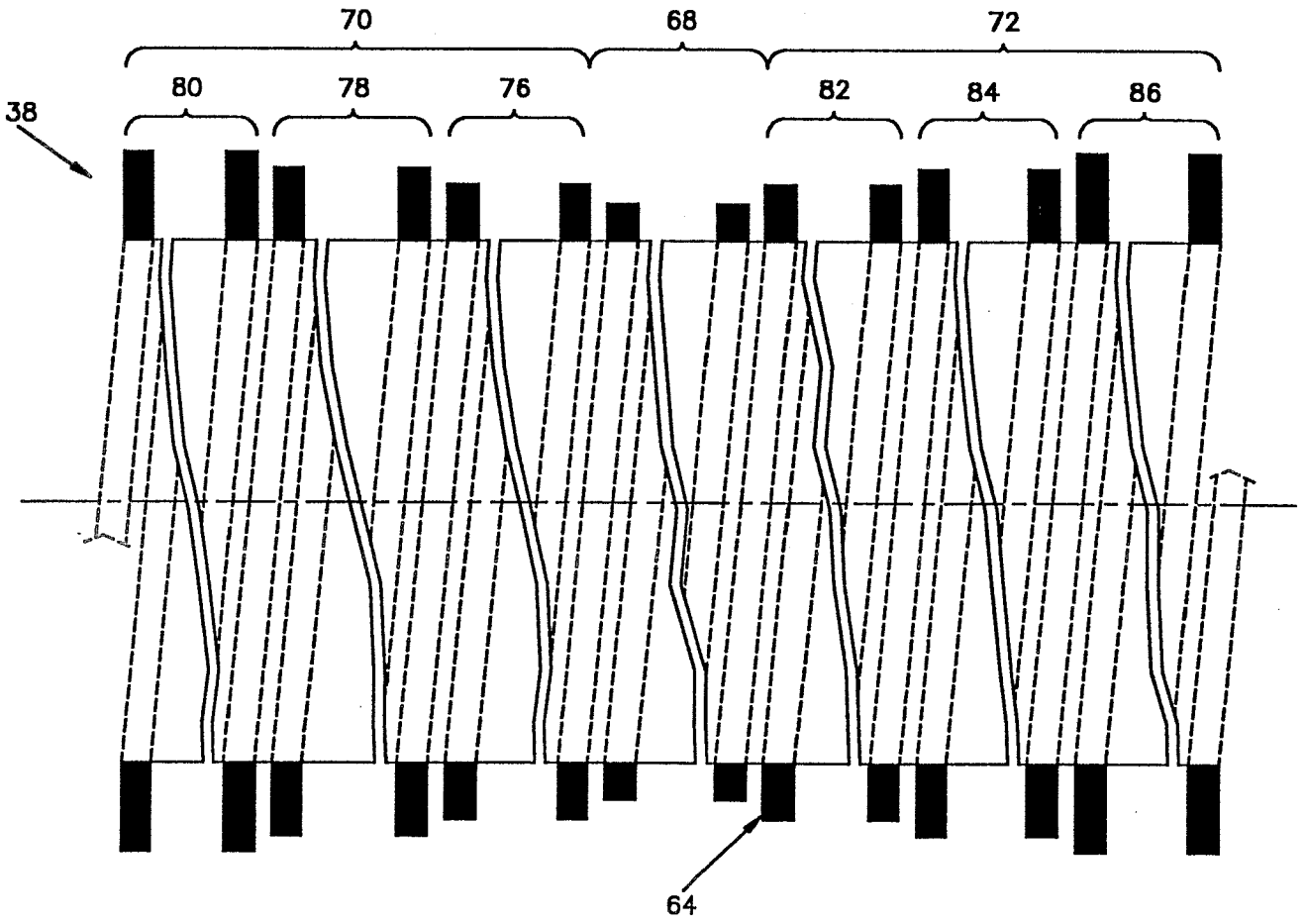
FIG. 5 is an enlarged, broken away schematic illustration of opposite end portions and a central portion of the brush dampener roll of FIG. 3.

The array 64 of bristles includes a central portion 68 (FIG. 3) disposed between opposite end portions 70 and 72. In accordance with a feature of the present invention, the bristles at the end portions 70 and 72 of the brush roll 38 are longer than the bristles at the central portion 68 of the brush roll (FIG. 5). By having the bristles at opposite end portions 70 and 72 of the brush roll 38 longer than the bristles at the central portion 68 of the dampener fountain roll, a relatively even transfer of ink repellant liquid 34 is obtained from the brush roll 38 (FIG. 2) throughout the length of the brush roll. This occurs even though the bristles at the opposite end portions 70 and 72 (FIG. 3) of the brush roll may tend to dry to a greater extent than the bristles at the central portion of the brush roll during operation of the lithographic printing press 10.

The first or left end portion 70 (FIG. 5) of the array 64 of bristles includes a first or innermost group 76 of bristles which are disposed adjacent to the central portion 68 of the array of bristles. The bristles in the first group 76 of bristles are longer than the bristles of the central portion 68 of the array 64 of bristles. A second group 78 of bristles is disposed axially outwardly of the first group 76 of bristles. The bristles of the second group 78 of bristles are longer than the bristles of the first group 76 of bristles. Finally, a third group 80 of bristles is disposed axially outwardly of the second group 78 of bristles. The bristles of the third group 80 of bristles are longer than the bristles of the second group 78 of bristles.

The opposite or second end portion 72 (FIG. 5) of the array 64 of bristles also includes three groups of bristles. Thus, a first group 82 of bristles are longer than the bristles of the central portion 68 of the array 64 of bristles. A second group 84 of bristles are longer than the bristles than the first group 82 of bristles. A third group 86 of bristles are longer than the bristles of the second group 84 of bristles.

The length of the bristles at the end portions 70 and 72 of the array 64 of bristles is longer than the bristles at the central portion 68 of the array of bristles. Therefore, the length of the bristles at the end portions 70 and 72 which engage the pan roll 36 (FIG. 2), is greater than the length of the bristles at the central portion 68 which engage the pan roll 36. Due to their longer length of engagement with the pan roll 36, it is believed that a greater length of the bristles in the end portions 70 and 72 of the array 64 of bristles is wetted with ink repellant liquid than in the central portion 68 of the array of bristles during rotation of the brush roll 38.

Since a greater length of the bristles in the end portions 70 and 72 of the array of bristles 64 is wetted during rotation of the brush roll 38, there is compensation for the tendency of the bristles at the end portions 70 and 72 of the array 64 of bristles to become drier than the bristles at the central portion 68 of the array of bristles. This promotes an even distribution of ink repellant liquid on the vibrator roll 40 and, therefore, on a printing plate mounted on the plate cylinder 18.

The tendency for the bristles in the array 64 of bristles to dry becomes greater as the distance from the central portion 68 of the array of bristles increases. Therefore, the bristles in the end portions 70 and 72 increase in length as the distance from the central portion 68 becomes greater. Thus, the bristles in the groups 80 and 86 of bristles at the axially outer ends of the outer end portions 70 and 72 of the array of bristles are longer than the bristles of the groups 78 and 84 of bristles. Similarly, the groups 78 and 84 of bristles are longer than the bristles of the groups 76 and 82 of bristles.

In one specific embodiment of the brush roll 38, the base cylinder 48 has an outside diameter of 3.750 inches. A cylindrical central portion 68 of the array 64 of bristles has an outside diameter of 5.00 inches. The groups 76 and 82 of bristles both have outside diameters of 5.025 inches. The groups 78 and 84 of bristles have diameters of 5.050 inches. Finally, the groups 80 and 86 of bristles have outside diameters of 5.075 inches.

The polymeric bristles of this specific brush roll 38 were placed in a long straight metal strip having a U-shaped cross sectional configuration. The strip of bristles was then wound in a helical groove formed in the base cylinder 48 and having a uniform pitch throughout its length. This results in the array 64 of bristles having a spiral configuration with the same spacing between each of the turns or coils of the spiral array.

The central portion 68 of the spiral array 64 of bristles includes 42 evenly spaced turns or coils. Each of the groups 76, 78, 80, 82, 84 and 86 of bristles includes eight coils or turns of bristles having the same even spacing as the central portion 68. Thus, the end portion 70 was formed of 24 coils or turns with eight of the coils or turns being in the group 76, another eight coils or turns being in group 78, and a final eight coils or turns being in the group 80. The overall length of this specific brush roll is approximately 66 inches.

The foregoing specific dimensions and number of turns or coils for various portions of the brush roll 38 have been set forth herein for purposes of clarity of description. It is contemplated that brush rolls constructed in accordance with the present invention will have different dimensions and/or different numbers of coils or turns. In fact, it is contemplated that the array 64 of bristles of a brush roll constructed in accordance with the present invention may not have the bristles arranged in a spiral configuration. Although it is preferred to have the various groups 76–86 of bristles of different lengths, the end portions 70 and 72 of the array 64 of bristles could be formed of bristles of the same length which would be longer than the length of the bristles in the central portion 68 of the array of bristles.

In view of the foregoing description, it is apparent that the present invention provides an improved dampener roll 38 (FIG. 2) for use in transferring ink repellant liquid 34 from a reservoir 32 to a printing plate in a lithographic printing press 10. The dampener roll 38 is of the brush type and includes an array 64 of bristles which extends between opposite end portions of the brush roll. The bristles at opposite end portions 70 and 72 (FIGS. 3 and 5) of the roll 38 are longer than bristles at the central portion 68 of the roll. It is believed that this results in a greater length of the bristles at the opposite end portions 70 and 72 of the roll 38 being wetted with dampening fluid than at the central portion 68 of the roll. It is believed that the wetting of a greater length of the bristles at the opposite ends of the roll 38 compensates for the tendency of the bristles at the opposite end portions of the roll 38 to dry out and thereby results in a more uniform rate of transfer of ink repellant liquid 34 along the length of the brush roll 38.

Having described one specific preferred embodiment of the invention, the following is claimed:

1. A dampener roll for use in transferring dampening fluid from a reservoir to a printing plate in a lithographic printing press, said dampener roll comprising a cylindrical base, said base including means for enabling said base to be rotatably mounted in the lithographic printing press adjacent to the reservoir of dampening fluid, an array of bristles connected to said base, said array of bristles circumscribing said base and extending between opposite end portions of said base, said array of bristles including a central portion which is formed of bristles of a first length, a first end portion which is formed of bristles of a length which is greater than said first length, and a second end portion which is formed of bristles of a length which is greater than said first length.

2. A dampener roll as set forth in claim 1 wherein the first end portion of said array of bristles includes a first group of bristles of a second length which is longer than said first length and a second group of bristles of a third length which is longer than said second length, said first group of bristles being disposed between said second group of bristles and the central portion of said array of bristles, the second end portion of said array of bristles including a third group of bristles of a fourth length which is longer than said first length and a fourth group of bristles of a fifth length which is longer than said fourth length, said third group of bristles being disposed between said fourth group of bristles and the central portion of said array of bristles.

3. A dampener roll as set forth in claim 2 wherein said first and third groups of bristles are of the same length and said second and fourth groups of bristles are of the same length.

4. A dampener roll as set forth in claim 1 wherein said array of bristles has a spiral configuration to form a spiral array of bristles, said central portion of said array of bristles including a first plurality of turns of said spiral array of bristles, said first end portion of said array of bristles including a second plurality of turns of said spiral array of bristles, said second end portion of said array of bristles including a third plurality of turns of said spiral array of bristles, said first plurality of turns of said spiral array of bristles including a greater number of turns than said second plurality of turns of said spiral array of bristles, said first plurality of turns of said spiral array of bristles including a greater number of turns than said third plurality of turns of said spiral array of bristles.

* * * * *